US006811876B2

(12) United States Patent
Bever et al.

(10) Patent No.: US 6,811,876 B2
(45) Date of Patent: Nov. 2, 2004

(54) MULTICOMPONENT FIBER

(75) Inventors: Paul-Michael Bever, Neustadt (DE); Gerhard Conzelmann, Otterstadt (DE); Bernd-Steffen von Bernstorff, Wachenheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/432,384

(22) PCT Filed: Nov. 22, 2001

(86) PCT No.: PCT/EP01/13576

§ 371 (c)(1),
(2), (4) Date: May 21, 2003

(87) PCT Pub. No.: WO02/42531

PCT Pub. Date: May 30, 2002

(65) Prior Publication Data

US 2004/0028897 A1 Feb. 12, 2004

(30) Foreign Application Priority Data

Nov. 23, 2000 (DE) ..... 100 58 291

(51) Int. Cl.[7] ..... D01F 8/00

(52) U.S. Cl. ..... 428/373; 428/374; 428/364; 428/399

(58) Field of Search ..... 428/373, 374, 428/364, 399; 528/310

(56) References Cited

U.S. PATENT DOCUMENTS

| | | | | |
|---|---|---|---|---|
| 4,596,742 A | | 6/1986 | Selviansky et al. | |
| 5,168,909 A | * | 12/1992 | Joyner, Jr. | 150/160 |
| 5,885,705 A | * | 3/1999 | Kent et al. | 428/373 |
| 6,136,433 A | * | 10/2000 | McIntosh et al. | 428/364 |
| 6,423,817 B1 | * | 7/2002 | Weinerth et al. | 528/310 |

FOREIGN PATENT DOCUMENTS

| | | |
|---|---|---|
| EP | 1 004 611 | 5/2000 |
| WO | 99/48949 | 9/1999 |

OTHER PUBLICATIONS

Ullmann's Encyclopedia of Ind.Chem,5thEd.vol. A10, 567–579.
Dictionary of Fiber & Textile Techyn. 28232,1990 159.

* cited by examiner

*Primary Examiner*—N. Edwards
(74) *Attorney, Agent, or Firm*—Keil & Weinkauf

(57) ABSTRACT

A fiber containing a longitudinal core (I) of a polymer and a chemically different surrounding sheath (II), wherein said sheath (II) is based on a polyamide containing a sterically hindered piperidine derivative (III) attached to the polymer chain by chemical bonding.

20 Claims, No Drawings

MULTICOMPONENT FIBER

DESCRIPTION

The present invention relates to a fiber containing a longitudinal core (I) of a polymer and a chemically different surrounding sheath (II), wherein said sheath (II) is based on a polyamide containing a sterically hindered piperidine derivative (III) attached to the polymer chain by chemical bonding.

The present invention further relates to the use of such a fiber for producing yarn, fabric and carpet.

The use of polymers, especially polyamides, for producing fiber and yarn is generally known, for example from: Ullmann's Encyclopedia of Industrial Chemistry, $5^{th}$ Ed., Vol. A10, VCH Verlagsgesellschaft mbH, Weinheim, Germany, 1987, pages 567–579.

Yarn is produced in a conventional manner by melting the polyamide, spinning the polyamide into a fiber, drawing and texturing this fiber and optionally aftertreating the fiber. This is customarily followed by cabling and heat setting of the yarn.

According to Dictionary of Fiber & Textile Technology, Hoechst Celanese Corporation, Charlotte, N.C. 28232, USA, 1990, p. 159, texturing, which also comprehends crimping, serves to increase yarn cover.

When carpet is produced from such yarn, a high crimp is desirable because high yarn cover means that less yarn is needed to cover a carpet.

It is an object of the present invention to provide a fiber from which yarn having improved crimp can be produced.

We have found that this object is achieved by the fiber defined at the beginning and the use of this fiber for producing yarn, fabric and carpet.

According to the invention, the fiber contains a longitudinal core (I) of a polymer.

Useful polymers advantageously include polymers that are meltable and spinnable from the melt, such as polyamides, polyesters, polyolefins, preferably polyamides, polyolefins, especially polyamides.

Polyamides are herein to be understood as being homopolymers, copolymers, blends and grafts of synthetic long-chain polyamides having recurring amide groups in the polymer main chain as an essential constituent. Examples of such polyamides are nylon-6 (polycaprolactam), nylon-6,6 (polyhexamethyleneadipamide), nylon-4,6 (polytetramethyleneadipamide), nylon-6,10 (polyhexamethylenesebacamide), nylon-7 (polyenantholactam), nylon-11 (polyundecanolactam), nylon-12 (polydodecanolactam). As well as polyamides known by the generic name of nylon, polyamides further include the aramids (aromatic polyamides), such as poly-meta-phenyleneisophthalamide (NOMEX® fiber, U.S. Pat. No. 3,287,324) or poly-para-phenyleneterephthalamide (KEVLAR® fiber, U.S. Pat. No. 3,671,542).

Polyamides can in principle be prepared by two methods.

In a polymerization from dicarboxylic acids and diamines and also in a polymerization from amino acids or their derivatives, such as aminocarbonitriles, aminocarboxamides, aminocarboxylate esters or aminocarboxylate salts, the amino and carboxyl end groups of the starting monomers or starting oligomers react with one another to form an amide group and water. The water can subsequently be removed from the polymer. In a polymerization from carboxamides, the amino and amide end groups of the starting monomers or starting oligomers react with one another to form an amide group and ammonia. The ammonia can subsequently be removed from the polymer. This polymerization reaction is customarily known as a polycondensation.

A polymerization from lactams as starting monomers or starting oligomers is customarily known as a polyaddition.

Such polyamides are obtainable by conventional processes, described for example in DE-A-14 95 198, DE-A-25 58 480, EP-A-129 196 or in: Polymerization Processes, Interscience, New York, 1977, pages 424–467, especially pages 444–446, from monomers selected from the group consisting of lactams, omega-aminocarboxylic acids, omega-aminocarbonitriles, omega-aminocarboxamides, omega-aminocarboxylate salts, omega-aminocarboxylate esters, equimolar mixtures of diamines and dicarboxylic acids, dicarboxylic acid/diamine salts, dinitriles and diamines or mixtures thereof.

Useful monomers include monomers or oligomers of a $C_2$ to $C_{20}$, preferably $C_2$ to $C_{18}$, arylaliphatic or, preferably, aliphatic lactam such as enantholactam, undecanolactam, dodecanolactam or caprolactam, monomers or oligomers of $C_2$ to $C_{20}$, preferably $C_3$ to $C_{18}$, aminocarboxylic acids such as 6-aminohexanoic acid or 11-aminoundecanoic acid, and dimers, trimers, tetramers, pentamers or hexamers thereof, and salts thereof such as alkali metal salts, for example lithium, sodium or potassium salts, $C_2$ to $C_{20}$, preferably $C_3$ to $C_{18}$, aminocarboxylic acid nitriles such as 6-aminocapronitrile or 11-aminoundecanoic acid nitrile, monomers or oligomers of $C_2$ to $C_{20}$ amino acid amides such as 6-aminohexanamide or 11-aminoundecanamide, and dimers, trimers, tetramers, pentamers or hexamers thereof, esters, preferably $C_1$–$C_4$ alkyl esters, such as methyl, ethyl, n-propyl, i-propyl, n-butyl, i-butyl or s-butyl esters, of $C_2$ to $C_{20}$, preferably $C_3$ to $C_{18}$, aminocarboxylic acids, such as 6-aminohexanoic acid esters, for example methyl 6-aminohexanoate, or 11-aminoundecanoic acid esters, for example methyl 11-aminoundecanoate, monomers or oligomers of a $C_2$ to $C_{20}$, preferably $C_2$ to $C_{12}$, alkyldiamine, such as tetramethylenediamine or, preferably, hexamethylenediamine, with a $C_2$ to $C_{20}$, preferably $C_2$ to $C_{14}$, aliphatic dicarboxylic acid or mono- or dinitriles thereof, such as sebacic acid, dodecanedioic acid, adipic acid, sebacic acid dinitrile, decanoic acid dinitrile or adiponitrile, and dimers, trimers, tetramers, pentamers or hexamers thereof, monomers or oligomers of a $C_2$ to $C_{20}$, preferably $C_2$ to $C_{12}$, alkyldiamine, such as tetramethylenediamine or, preferably, hexamethylenediamine, with a $C_8$ to $C_{20}$, preferably $C_8$ to $C_{12}$, aromatic dicarboxylic acid or derivatives thereof, for example chlorides, such as naphthalene-2,6-dicarboxylic acid, preferably isophthalic acid or terephthalic acid, and dimers, trimers, tetramers, pentamers or hexamers thereof, monomers or oligomers of a $C_2$ to $C_{20}$, preferably $C_2$ to $C_{12}$, alkyldiamine, such as tetramethylenediamine or, preferably, hexamethylenediamine, with a $C_9$ to $C_{20}$, preferably $C_9$ to $C_{18}$, arylaliphatic dicarboxylic acid or derivatives thereof, for example chlorides, such as o-, m- or p-phenylenediacetic acid, and dimers, trimers, tetramers, pentamers or hexamers thereof, monomers or oligomers of a $C_6$ to $C_{20}$, preferably $C_6$ to $C_{10}$, aromatic diamine, such as m- or p-phenylenediamine, with a $C_2$ to $C_{20}$, preferably $C_2$ to $C_{14}$, aliphatic dicarboxylic acid or mono- or dinitriles thereof, such as sebacic acid, dodecanedioic acid, adipic acid, sebacic acid dinitrile, decanoic acid dinitrile or adiponitrile, and dimers, trimers, tetramers, pentamers or hexamers thereof, monomers or oligomers of a $C_6$ to $C_{20}$, preferably $C_6$ to $C_{10}$, aromatic diamine, such as m- or p-phenylenediamine, with a $C_8$ to $C_{20}$, preferably $C_8$ to $C_{12}$, aromatic dicarboxylic acid or derivatives thereof, for example chlorides, such as naphthalene-2,6-dicarboxylic acid, preferably isophthalic acid or terephthalic acid, and dimers, trimers, tetramers, pentamers or hexamers thereof, monomers or oligomers of a $C_6$ to $C_{20}$, preferably $C_6$ to $C_{10}$, aromatic diamine, such as m- or p-phenylenediamine, with a $C_9$ to $C_{20}$, preferably $C_9$ to $C_{18}$, arylaliphatic dicarboxylic acid or derivatives thereof, for example chlorides, such as o-, m- or p-phenylenediacetic acid, and dimers, trimers, tetramers, pentamers or hexamers thereof, monomers or oligomers of a $C_7$ to $C_{20}$, preferably $C_8$ to $C_{18}$, arylaliphatic diamine, such as m- or p-xylylenediamine, with a $C_2$ to $C_{20}$, preferably $C_2$ to $C_{14}$, aliphatic dicarboxylic acid or mono- or dinitriles thereof, such as sebacic acid, dodecanedioic acid, adipic acid, sebacic acid dinitrile, decanoic acid dinitrile or adiponitrile, and dimers, trimers, tetramers, pentamers or hexamers thereof, monomers or oligomers of a $C_7$ to $C_{20}$, preferably $C_8$ to $C_{18}$, arylaliphatic diamine, such as m- or p-xylylenediamine, with a $C_6$ to $C_{20}$, preferably $C_6$ to $C_{10}$, aromatic dicarboxylic acid or derivatives thereof, for example chlorides, such as naphthalene-2,6-dicarboxylic acid, preferably isophthalic acid or terephthalic acid, and dimers, trimers, tetramers, pentamers or hexamers thereof, monomers or oligomers of a $C_7$ to $C_{20}$, preferably $C_8$ to $C_{18}$, arylaliphatic diamine, such as m- or p-xylylenediamine, with a $C_9$ to $C_{20}$, preferably $C_9$ to $C_{18}$, arylaliphatic dicarboxylic acid or derivatives thereof, for example chlorides, such as o-, m- or p-phenylenediacetic acid, and dimers, trimers, tetramers, pentamers or hexamers thereof, and homopolymers, copolymers, mixtures and grafts of such starting monomers or starting oligomers.

In a preferred embodiment, the lactam used is caprolactam, the diamine used is tetramethylenediamine, hexamethylenediamine or their mixtures and the dicarboxylic acid used is adipic acid, sebacic acid, dodecanedioic acid, terephthalic acid, isophthalic acid or mixtures thereof. Particular preference is given to the lactam being caprolactam, the diamine being hexamethylenediamine and the dicarboxylic acid being adipic acid or terephthalic acid or their mixtures.

Particular preference is given to those starting monomers or oligomers which on polymerization lead to the polyamides nylon-6, nylon-6,6, nylon-4,6, nylon-6,10, nylon-6,12, nylon-7, nylon-11 or nylon-12 or the aramids poly-meta-phenyleneisophthalamide or poly-para-phenyleneterephthalamide, especially to nylon 6 or nylon 66.

In a preferred embodiment, the polyamides may be prepared using one or more chain regulators. Useful chain regulators advantageously include compounds having one or more, such as two, amino groups reactive in polyamide formation or one or more, such as two, carboxyl groups reactive in polyamide formation.

The first case provides fibers wherein said monomers used for preparing said polyamide of said core (I) have a higher number of amine groups, or their equivalents, used for forming said polymer chain than carboxylic acid groups, or their equivalents, used for forming said polymer chain.

The second case provides fibers wherein said monomers used for preparing said polyamide of said core (I) have a higher number of carboxylic acid groups, or their equivalents, used for forming said polymer chain than amine groups, or their equivalents, used for forming said polymer chain.

Useful chain regulators advantageously include monocarboxylic acids, such as alkanecarboxylic acids, for example acetic acid, propionic acid, such as benzene- or naphthalene-monocarboxylic acid, for example benzoic acid, dicarboxylic acids, such as $C_4$–$C_{10}$-alkanedicarboxylic acid, for example adipic acid, azelaic acid, sebacic acid, dodecanedioic acid, $C_5$–$C_8$-cycloalkanedicarboxylic acids, for example cyclohexane-1,4-dicarboxylic acid, benzene- or naphthalenedicarboxylic acid, for example terephthalic acid, isophthalic acid, naphthalene-2,6-dicarboxylic acid, $C_2$ to $C_{20}$, preferably $C_2$ to $C_{12}$, alkylamines, such as cyclohexylamine, $C_6$ to $C_{20}$, preferably $C_6$ to $C_{10}$, aromatic monoamines, such as aniline, or $C_7$ to $C_{20}$, preferably $C_8$ to $C_{18}$, arylaliphatic monoamines, such as benzylamine, diamines, such as $C_4$–$C_{10}$-alkanediamines, for example hexamethylenediamine.

A chain regulator may advantageously be used in amounts of not less than 0.01 mol %, preferably not less than 0.05 mol %, especially not less than 0.2 mol %, based on 1 mol of acid amide groups of the polyamide.

A chain regulator may advantageously be used in amounts of not more than 1.0 mol %, preferably not more than 0.6 mol %, especially not more than 0.5 mol %, based on 1 mol of acid amide groups of the polyamide.

In another preferred embodiment, the polymerization or polycondensation in the process of the invention is carried out in the presence of at least one pigment. Preferred pigments are titanium dioxide, preferably titanium dioxide in the anatase modification, or coloring compounds of inorganic or organic nature. The pigments are preferably added in an amount of from 0 to 5 parts by weight, especially from 0.02 to 2 parts by weight, based on 100 parts by weight of polyamide. The pigments may be added to the reactor together with the starting materials or separately therefrom.

Polyolefins for the purposes of the present invention are homopolymers, copolymers, blends and grafts of synthetic long-chain polyolefins obtainable by polymerization of olefinically unsaturated compounds, such as ethylene, propylene, styrene, acrylic acid and esters thereof, methacrylic acid and esters thereof, preferably propylene.

Such polyolefins may be prepared in a conventional manner.

According to the invention, the core (I) of the fiber is surrounded by a sheath (II), wherein said sheath (II) is based on a polyamide containing a sterically hindered piperidine derivative (III) attached to the polymer chain by chemical bonding.

Polyamides are herein to be understood as being homopolymers, copolymers, blends and grafts of synthetic long-chain polyamides having recurring amide groups in the polymer main chain as an essential constituent. Examples of such polyamides are nylon-6 (polycaprolactam), nylon-6,6 (polyhexamethyleneadipamide), nylon-4,6 (polytetramethyleneadipamide), nylon-6,10 (polyhexamethylenesebacamide), nylon-6,12 (polyhexamethylenedodecanedioic acid amide), nylon-7 (polyenantholactam), nylon-11 (polyundecanolactam), nylon-12 (polydodecanolactam). As well as polyamides known by the generic name of nylon, polyamides further include the so-called aramids (aromatic polyamides), such as poly-meta-phenyleneisophthalamide (NOMEX® fiber, U.S. Pat. No. 3,287,324) or poly-para-phenyleneterephthalamide (KEVLAR® fiber, U.S. Pat. No. 3,671,542).

Polyamides can in principle be prepared by two methods.

In a polymerization from dicarboxylic acids and diamines and also in a polymerization from amino acids or their derivatives, such as aminocarbonitriles, aminocarboxamides, aminocarboxylate esters or aminocarboxylate salts, the amino and carboxyl end groups of the starting monomers or starting oligomers react with one another to form an amide group and water. The water can subsequently be removed from the polymer. In a polymerization from carboxamides, the amino and amide end groups of the starting monomers or starting oligomers react with one another to form an amide group and ammonia. The ammonia can subsequently be removed from the polymer. This polymerization reaction is customarily known as a polycondensation.

A polymerization from lactams as starting monomers or starting oligomers is customarily known as a polyaddition.

Such polyamides are obtainable by conventional processes, described for example in DE-A-14 95 198, DE-A-25 58 480, EP-A-129 196 or in: Polymerization Processes, Interscience, New York, 1977, pages 424–467, especially pages 444–446, from monomers selected from the group consisting of lactams, omega-aminocarboxylic acids, omega-aminocarbonitriles, omega-aminocarboxamides, omega-aminocarboxylate salts, omega-aminocarboxylate esters, equimolar mixtures of diamines and dicarboxylic acids, dicarboxylic acid/diamine salts, dinitriles and diamines or mixtures thereof.

Useful monomers include monomers or oligomers of a $C_2$ to $C_{20}$, preferably $C_2$ to $C_{18}$, arylaliphatic or, preferably, aliphatic lactam such as enantholactam, undecanolactam, dodecanolactam or caprolactam, monomers or oligomers of $C_2$ to $C_{20}$, preferably $C_3$ to $C_{18}$, aminocarboxylic acids such as 6-aminohexanoic acid or 11-aminoundecanoic acid, and dimers, trimers, tetramers, pentamers or hexamers thereof, and salts thereof such as alkali metal salts, for example lithium, sodium or potassium salts, $C_2$ to $C_{20}$, preferably $C_3$ to $C_{18}$, aminocarboxylic acid nitriles such as 6-aminocapronitrile or 11-aminoundecanoic acid nitrile, monomers or oligomers of $C_2$ to $C_{20}$ amino acid amides such as 6-aminohexanamide or 11-aminoundecanamide, and dimers, trimers, tetramers, pentamers or hexamers thereof, esters, preferably $C_1$–$C_4$ alkyl esters, such as methyl, ethyl, n-propyl, i-propyl, n-butyl, i-butyl or s-butyl esters, of $C_2$ to $C_{20}$, preferably $C_3$ to $C_{18}$, aminocarboxylic acids, such as 6-aminohexanoic acid esters, for example methyl 6-aminohexanoate, or 11-aminoundecanoic acid esters, for example methyl 11-aminoundecanoate, monomers or oligomers of a $C_2$ to $C_{20}$, preferably $C_2$ to $C_{12}$, alkyldiamine, such as tetramethylenediamine or, preferably, hexamethylenediamine, with a $C_2$ to $C_{20}$, preferably $C_2$ to $C_{14}$, aliphatic dicarboxylic acid or mono- or dinitriles thereof, such as sebacic acid, dodecanedioic acid, adipic acid, sebacic acid dinitrile, decanoic acid dinitrile or adiponitrile, and dimers, trimers, tetramers, pentamers or hexamers thereof, monomers or oligomers of a $C_2$ to $C_{20}$, preferably $C_2$ to $C_{12}$, alkyldiamine, such as tetramethylenediamine or, preferably, hexamethylenediamine, with a $C_8$ to $C_{20}$, preferably $C_8$ to $C_{12}$, aromatic dicarboxylic acid or derivatives thereof, for example chlorides, such as naphthalene-2,6-dicarboxylic acid, preferably isophthalic acid or terephthalic acid, and dimers, trimers, tetramers, pentamers or hexamers thereof, monomers or oligomers of a $C_2$ to $C_{20}$, preferably $C_2$ to $C_{12}$, alkyldiamine, such as tetramethylenediamine or, preferably, hexamethylenediamine, with a $C_9$ to $C_{20}$, preferably $C_9$ to $C_{18}$, arylaliphatic dicarboxylic acid or derivatives thereof, for example chlorides, such as o-, m- or p-phenylenediacetic acid, and dimers, trimers, tetramers, pentamers or hexamers thereof, monomers or oligomers of a $C_6$ to $C_{20}$, preferably $C_6$ to $C_{10}$, aromatic diamine, such as m- or p-phenylenediamine, with a $C_2$ to $C_{20}$, preferably $C_2$ to $C_{14}$, aliphatic dicarboxylic acid or mono- or dinitriles thereof, such as sebacic acid, dodecanedioic acid, adipic acid, sebacic acid dinitrile, decanoic acid dinitrile or adiponitrile, and dimers, trimers, tetramers, pentamers or hexamers thereof, monomers or oligomers of a $C_6$ to $C_{20}$, preferably $C_6$ to $C_{10}$, aromatic diamine, such as m- or p-phenylenediamine, with a $C_8$ to $C_{20}$, preferably $C_8$ to $C_{12}$, aromatic dicarboxylic acid or derivatives thereof, for example chlorides, such as naphthalene-2,6-dicarboxylic acid, preferably isophthalic acid or terephthalic acid, and dimers, trimers, tetramers, pentamers or hexamers thereof, monomers or oligomers of a $C_6$ to $C_{20}$, preferably $C_6$ to $C_{10}$, aromatic diamine, such as m- or p-phenylenediamine, with a $C_9$ to $C_{20}$, preferably $C_9$ to $C_{18}$, arylaliphatic dicarboxylic acid or derivatives thereof, for example chlorides, such as o-, m- or p-phenylenediacetic acid, and dimers, trimers, tetramers, pentamers or hexamers thereof, monomers or oligomers of a $C_7$ to $C_{20}$, preferably $C_8$ to $C_{18}$, arylaliphatic diamine, such as m- or p-xylylenediamine, with a $C_2$ to $C_{20}$, preferably $C_2$ to $C_{14}$, aliphatic dicarboxylic acid or mono- or dinitriles thereof, such as sebacic acid, dodecanedioic acid, adipic acid, sebacic acid dinitrile, decanoic acid dinitrile or adiponitrile, and dimers, trimers, tetramers, pentamers or hexamers thereof, monomers or oligomers of a $C_7$ to $C_{20}$, preferably $C_8$ to $C_{18}$, arylaliphatic diamine, such as m- or p-xylylenediamine, with a $C_6$ to $C_{20}$, preferably $C_6$ to $C_{10}$, aromatic dicarboxylic acid or derivatives thereof, for example chlorides, such as naphthalene-2,6-dicarboxylic acid, preferably isophthalic acid or terephthalic acid, and dimers, trimers, tetramers, pentamers or hexamers thereof, monomers or oligomers of a $C_7$ to $C_{20}$, preferably $C_8$ to $C_{18}$, arylaliphatic diamine, such as m- or p-xylylenediamine, with a $C_9$ to $C_{20}$, preferably $C_9$ to $C_{18}$, arylaliphatic dicarboxylic acid or derivatives thereof, for example chlorides, such as o-, m- or p-phenylenediacetic acid, and dimers, trimers, tetramers, pentamers or hexamers thereof, and homopolymers, copolymers, mixtures and grafts of such starting monomers or starting oligomers.

In a preferred embodiment, the lactam used is caprolactam, the diamine used is tetramethylenediamine, hexamethylenediamine or their mixtures and the dicarboxylic acid used is adipic acid, sebacic acid, dodecanedioic acid, terephthalic acid, isophthalic acid or mixtures thereof. Particular preference is given to the lactam being caprolactam, the diamine being hexamethylenediamine and the dicarboxylic acid being adipic acid or terephthalic acid or their mixtures.

Particular preference is given to those starting monomers or oligomers which on polymerization lead to the polyamides nylon-6, nylon-6,6, nylon-4,6, nylon-6,10, nylon-6,12, nylon-7, nylon-11 or nylon-12 or the aramids poly-metaphenyleneisophthalamide or poly-para-phenyleneterephthalamide, especially to nylon 6 or nylon 66.

In a preferred embodiment, the polyamides may be prepared using one or more chain regulators. Useful chain regulators advantageously include compounds having one or more, such as two, amino groups reactive in polyamide formation or one or more, such as two, carboxyl groups reactive in polyamide formation.

The first case provides fibers wherein said monomers used for preparing said polyamide of said core (I) have a higher number of amine groups, or their equivalents, used for forming said polymer chain than carboxylic acid groups, or their equivalents, used for forming said polymer chain.

The second case provides fibers wherein said monomers used for preparing said polyamide of said core (I) have a higher number of carboxylic acid groups, or their equivalents, used for forming said polymer chain than amine groups, or their equivalents, used for forming said polymer chain.

Useful chain regulators advantageously include monocarboxylic acids, such as alkanecarboxylic acids, for example acetic acid, propionic acid, such as benzene- or naphthalenemonocarboxylic acid, for example benzoic acid, dicarboxylic acids, such as $C_4$–$C_{10}$-alkanedicarboxylic acid, for example adipic acid, azelaic acid, sebacic acid, dodecanedioic acid, $C_5$–$C_8$-cycloalkanedicarboxylic acids, for example cyclohexane-1,4-dicarboxylic acid, benzene- or naphthalenedicarboxylic acid, for example terephthalic acid, isophthalic acid, naphthalene-2,6-dicarboxylic acid, $C_2$ to $C_{20}$, preferably $C_2$ to $C_{12}$, alkylamines, such as cyclohexylamine, $C_6$ to $C_{20}$, preferably $C_6$ to $C_{10}$, aromatic monoamines, such as aniline, or $C_7$ to $C_{20}$, preferably $C_8$ to $C_{18}$, arylaliphatic monoamines, such as benzylamine, diamines, such as $C_4$–$C_{10}$-alkanediamines, for example hexamethylenediamine.

Such chain regulators may carry substituents, such as halogens, for example fluorine, chlorine or bromine, sulfonic acid groups or salts thereof, such as lithium, sodium or potassium salts, or be unsubstituted.

Preference is given to sulfonated dicarboxylic acids, especially sulfoisophthalic acid, and also one of its salts, such as alkali metal salts, for example lithium, sodium or potassium salts, preferably lithium or sodium salt, especially lithium salt.

A chain regulator may advantageously be used in amounts of not less than 0.01 mol %, preferably not less than 0.05 mol %, especially not less than 0.2 mol %, based on 1 mol of acid amide groups of the polyamide.

A chain regulator may advantageously be used in amounts of not more than 1.0 mol %, preferably not more than 0.6 mol %, especially not more than 0.5 mol %, based on 1 mol of acid amide groups of the polyamide.

According to the invention, the sheath (II) contains a polyamide containing a sterically hindered piperidine derivative (III) attached to the polymer chain by chemical bonding.

Preference as compounds (III) is given to those of the formula

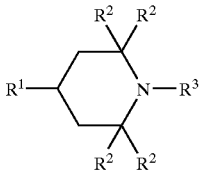

where $R^1$ is a functional group capable of amide formation with respect to the polymer chain of the polyamide of sheath (II), preferably a group —(NH)$R^5$, in which $R^5$ is hydrogen or $C_1$–$C_8$ alkyl, or a carboxyl group, or a carboxyl derivative, or a group —$(CH_2)_x$(NH)$R^5$, in which X is 1 to 6 and $R^5$ is hydrogen or $C_1$–$C_8$ alkyl, or a group —$(CH_2)_y$COOH, in which Y is 1 to 6, or a —$(CH_2)_y$COOH acid derivative, in which Y is 1 to 6, especially a group —$NH_2$, $R^2$ is an alkyl group, preferably a $C_1$–$C_4$ alkyl group such as methyl, ethyl, n-propyl, i-propyl, n-butyl, i-butyl or s-butyl, especially a methyl group, $R^3$ is hydrogen, $C_1$–$C_4$ alkyl or O—$R^4$, in which $R^4$ is hydrogen or $C_1$–$C_7$ alkyl, $R^3$ being hydrogen in particular.

In such compounds, steric hindrance usually prevents the tertiary amino groups, and especially the secondary amino groups, of the piperidine ring system from reacting.

A particularly preferred compound (III) is 4-amino-2,2,6,6-tetramethylpiperidine.

A compound (III) may advantageously be used in amounts of not less than 0.01 mol %, preferably not less than 0.05 mol %, especially not less than 0.1 mol %, based on 1 mol of acid amide groups of the polyamide.

A compound (II) may advantageously be used in amounts of not more than 0.8 mol %, preferably not more than 0.6 mol %, especially not more than 0.4 mol %, based on 1 mol of acid amide groups of the polyamide.

In another preferred embodiment, the polymerization or polycondensation in the process of the invention is carried out in the presence of at least one pigment. Preferred pigments are titanium dioxide, preferably titanium dioxide in the anatase modification, or coloring compounds of inorganic or organic nature. The pigments are preferably added in an amount of from 0 to 5 parts by weight, especially from 0.02 to 2 parts by weight, based on 100 parts by weight of polyamide. The pigments may be added to the reactor together with the starting materials or separately therefrom.

Polyamides advantageously useful as sheath (II), which contain a sterically hindered piperidine derivative (III) attached to the polymer chain by chemical bonding, are described for example in WO 95/28443, WO 97/05189, WO 98/50610, WO 99/46323, WO 99/48949, EP-A-822 275, EP-A-843 696 and the two German applications 10030515.6 and 10030512.1.

According to the invention, core (I) and sheath (II) are chemically different.

Advantageously, core (I) and sheath (II) contain a different amount of sterically hindered piperidine derivative (III) attached to the polymer chain by chemical bonding, this amount being preferably less in core (I) than in sheath (II), especially this amount being in core (I), reckoned on a molar basis, less than 50% of this amount in sheath (II). In a particularly preferred embodiment, core (I) contains no sterically hindered piperidine derivative (III) attached to the polymer chain by chemical bonding.

The fibers may be produced in a conventional manner for example as in U.S. Pat. Nos. 3,803,453, 5,445,884, 5,447,794, 5,888,651, EP-A-410 415, EP-A-056 667.

For instance, the polymer for core (I) and the polyamide for sheath (II) may be prepared separately, a melt of each conveyed by a conveying device, such as an extruder, to a spinneret and spun into fiber there, especially by high speed spinning at takeoff speeds of not less than 4000 m/min.

In advantageously contemplated fibers, the weight ratio of said sheath (II) to said core (I) is in the range from 5:95 to 80:20, preferably from 5:95 to 50:50.

The fiber of the invention may be used in a conventional manner to produce yarn, fabric and carpet, as already described at the beginning.

EXAMPLES

The following polyamides were used:

Polyamide 1: Ultramid ® UV 2603 C (BASF Aktiengesellschaft), unpigmented

Polymerized from 1% by weight of lithium sulfoisophthalate, 0.07% by weight of hexamethylenediamine, 0.15% by weight of 4-amino-2,2,6,6-tetramethylpiperidine, remainder caprolactam Polyamide 2: Ultramid ® UV 2603 C (BASF Aktiengesellschaft), pigmented Polymerized from 1% by weight of lithium sulfoisophthalate, 0.07% by weight of hexamethylenediamine, 0.15% by weight of 4-amino-2,2,6,6-tetramethylpiperidine, 0.3% by weight of titanium dioxide, remainder caprolactam Polyamide 3: Ultramid ® BS 700 (BASF Aktiengesellschaft), unpigmented Polymerized from 0.15% by weight of propionic acid, remainder caprolactam Polyamide 4: Ultramid ® BS 700 (BASF Aktiengesellschaft), pigmented Polymerized from 0.15% by weight of propionic acid, 0.3% by weight of Palamid Red color pigment, remainder caprolactam The polyamides of table 1 were used to spin 2700 dtex round fiber having a weight ratio of 70:30 for core (I) to sheath (II), which was draw-textured to obtain the data shown in the Table.

TABLE 1

| Example | Core | Sheath | Crimp [%] |
|---|---|---|---|
| Inventive 1 | Polyamide 1 | Polyamide 4 | 5.1 |
| Inventive 2 | Polyamide 3 | Polyamide 3 | 5.1 |
| Comparative 1 | Polyamide 4 | | 4.8 |
| Comparative 2 | Polyamide 2 | | 4.5 |

The table shows that the inventive fibers possess better crimp than prior art fibers consisting exclusively of the material of sheath (II) (comparative example 1) or exclusively of the material of core (I) (comparative example 2).

We claim:

1. A fiber containing a longitudinal core (I) of a polymer and a chemically different surrounding sheath (II), wherein said sheath (II) is based on a polyamide containing a sterically hindered piperidine compound (III) attached to the polymer chain by chemical bonding.

2. The fiber of claim 1, wherein the weight ratio of said sheath (II) to said core (I) is in the range from 5:95 to 80:20.

3. The fiber of claim 1, wherein the weight ratio of said sheath (II) to said core (I) is in the range from 5:95 to 50:50.

4. The fiber of claim 1, wherein said sheath (II) contains from 0.03 to 0.8 mol %, based on 1 mol of acid amide group of said polyamide in said sheath (II), of amine radical of the formula (III).

5. The fiber of claim 1, wherein compound (III) is 4-amino-2,2,6,6-tetramethylpiperidine and it is attached to said polymer chain by an amide bond.

6. The fiber of claim 1, wherein said sheath (II) is based on a polyamide obtainable from monomers selected from the group consisting of lactams, omega-aminocarboxylic acids, omega-aminocarbonitriles, omega-aminocarboxamides, omega-aminocarboxylate salts, omega-aminocarboxylate esters, equimolar mixtures of diamines and dicarboxylic acids, dicarboxylic acid/diamine salts, dinitriles and diamines or mixtures thereof.

7. The fiber of claim 1, wherein said core (I) is based on a polyamide.

8. The fiber of claim 1, wherein said core (I) is based on a polyamide obtainable from monomers selected from the group consisting of lactams, omega-aminocarboxylic acids, omega-aminocarbonitriles, omega-aminocarboxamides, omega-aminocarboxylate salts, omega-aminocarboxylate esters, equimolar mixtures of diamines and dicarboxylic acids, dicarboxylic acid/diamine salts, dinitriles and diamines or mixtures thereof.

9. The fiber of claim 6, wherein the lactam is caprolactam.

10. The fiber of claim 6, wherein the diamine is tetramethylenediamine, hexamethylenediamine or their mixture.

11. The fiber of claim 6, wherein the dicarboxylic acid is adipic acid, sebacic acid, dodecanedioic acid, terephthalic acid, isophthalic acid or a mixture thereof.

12. The fiber of claim 1, wherein said sheath (II) contains a sulfonated dicarboxylic acid, or a salt thereof, bonded to the polymer chain.

13. The fiber of claim 12, wherein said sulfonated dicarboxylic acid is sulfoisophthalic acid.

14. The fiber of claim 6, wherein said monomers for preparing said polyamide of said sheath (II) have a higher number of amine groups, or their equivalents, used for forming said polymer chain than carboxylic acid groups, or their equivalents, used for forming said polymer chain.

15. The fiber of claim 6, wherein said monomers for preparing said polyamide of said sheath (II) have a higher number of carboxylic acid groups, or their equivalents, used for forming said polymer chain than amine groups, or their equivalents, used for forming said polymer chain.

16. The fiber as claimed in claim 1 for producing yarn, fabric and carpet.

17. The fiber of claim 6, wherein said core (I) is based on a polyamide.

18. The fiber of claim 17, wherein said core (I) is based on a polyamide obtainable from monomers selected from the group consisting of lactams, omega-aminocarboxylic acids, omega-aminocar-bonitriles, omega-aminocarboxamides, omega-aminocarboxylate salts, omega-aminocarboxylate esters, equimolar mixtures of diamines and dicarboxylic acids, dicarboxylic acid/diamine salts, dinitriles and diamines or mixtures thereof.

19. The fiber of claim 17, wherein said sheath (II) contains a sulfonated dicarboxylic acid, or a salt thereof, bonded to the polymer chain.

20. The fiber of claim 19, wherein said sulfonated dicarboxylic acid is sulfoisophthalic acid.

* * * * *